US010822762B2

(12) United States Patent
Thomas et al.

(10) Patent No.: US 10,822,762 B2
(45) Date of Patent: Nov. 3, 2020

(54) COMBINATION PIER

(71) Applicant: PPI ENGINEERING & CONSTRUCTION SERVICES, LLC, Houston, TX (US)

(72) Inventors: Ronald D. Thomas, Kingwood, TX (US); Tommy L. Williamson, New Braunsfels, TX (US)

(73) Assignee: PPI ENGINEERING & CONSTRUCTION SERVICES, LLC, Houston, TX (US)

( * ) Notice: Subject to any disclaimer, the term of this patent is extended or adjusted under 35 U.S.C. 154(b) by 0 days.

(21) Appl. No.: 15/810,203

(22) Filed: Nov. 13, 2017

(65) Prior Publication Data

US 2018/0355573 A1 Dec. 13, 2018

Related U.S. Application Data

(60) Provisional application No. 62/518,115, filed on Jun. 12, 2017.

(51) Int. Cl.

| | |
|---|---|
| ***E02D 3/08*** | (2006.01) |
| ***E02D 5/34*** | (2006.01) |
| ***E02D 5/48*** | (2006.01) |
| ***E02D 27/12*** | (2006.01) |
| ***E02D 7/00*** | (2006.01) |
| ***E02D 5/36*** | (2006.01) |
| ***E02D 31/00*** | (2006.01) |

(52) U.S. Cl.

CPC ..... *E02D 5/48* (2013.01); *E02D 3/08* (2013.01); *E02D 5/34* (2013.01); *E02D 5/36* (2013.01); *E02D 7/00* (2013.01); *E02D 27/12* (2013.01); *E02D 31/00* (2013.01); *E02D 2250/00* (2013.01); *E02D 2250/0023* (2013.01); *E02D 2300/002* (2013.01)

(58) Field of Classification Search

CPC .... E02D 3/08; E02D 5/34; E02D 5/48; E02D 5/50; E02D 5/62; E02D 27/12; E02D 27/14; E02D 27/16

USPC ..... 405/230, 233, 250, 251

See application file for complete search history.

(56) References Cited

U.S. PATENT DOCUMENTS

| | | | | |
|---|---|---|---|---|
| 1,856,517 A * | 5/1932 | Smith | ..... | E02D 5/48 405/233 |
| 3,638,433 A * | 2/1972 | Sherard | ..... | E02D 1/04 405/50 |
| 3,654,767 A * | 4/1972 | Cavin | ..... | E02D 5/50 405/241 |

(Continued)

FOREIGN PATENT DOCUMENTS

| | | | | |
|---|---|---|---|---|
| DE | 102005001227 A1 * | 7/2006 | ..... | E02D 5/48 |
| EP | 2390419 * | 11/2011 | | |

(Continued)

*Primary Examiner* — Frederick L Lagman

(74) *Attorney, Agent, or Firm* — Nolte Intellectual Property Law Group

(57) ABSTRACT

A combination pier includes: a pile disposed in a bore hole from the bottom of the bore hole to a desired depth; and a pier disposed in the bore hole from the desired depth to the surface. A method for constructing a combination pier includes: forming a pile in a bore hole from the bottom of the bore hole to a desired depth; and forming a pier from the desired depth to the surface.

9 Claims, 4 Drawing Sheets

(56) References Cited

U.S. PATENT DOCUMENTS

| | | | | | |
|---|---|---|---|---|---|
| 4,023,325 | A * | 5/1977 | Paverman | E02D 3/08 | 405/229 |
| 4,063,423 | A * | 12/1977 | Gurkov | E02D 5/36 | 405/239 |
| 4,504,173 | A * | 3/1985 | Feklin | E02D 5/36 | 405/240 |
| 4,832,535 | A * | 5/1989 | Crambes | E02D 3/08 | 405/117 |
| 5,249,892 | A * | 10/1993 | Fox | E02D 3/054 | 404/133.1 |
| 6,183,166 | B1 * | 2/2001 | Schellhorn | E02D 5/38 | 405/233 |
| 6,354,766 | B1 * | 3/2002 | Fox | E02D 3/08 | 405/232 |
| 6,354,768 | B1 * | 3/2002 | Fox | E02D 3/02 | 405/238 |
| 6,688,815 | B2 * | 2/2004 | Fox | E02D 3/08 | 175/23 |
| 7,226,246 | B2 * | 6/2007 | Fox | E02D 3/08 | 175/424 |
| 8,152,415 | B2 * | 4/2012 | Fox | E02D 5/44 | 175/424 |
| 9,169,611 | B2 * | 10/2015 | Fox | E02D 3/08 | |
| 2007/0189859 | A1 * | 8/2007 | Gunther | E02D 3/126 | 405/233 |
| 2015/0139739 | A1 * | 5/2015 | Song | E02D 3/08 | 405/232 |
| 2017/0058477 | A1 * | 3/2017 | Niroumand | E02D 3/08 | |

FOREIGN PATENT DOCUMENTS

| | | | | |
|---|---|---|---|---|
| EP | 1688543 | * | 12/2012 | |
| GB | 2120305 A | * | 11/1983 | E02D 5/48 |

* cited by examiner

COMBINATION PIER

CROSS-REFERENCE TO RELATED APPLICATIONS

This application claims the benefit of U.S. Provisional Patent Application Ser. No. 62/518,115, which was filed Jun. 12, 2017. The aforementioned patent application is hereby incorporated by reference in its entirety into the present application to the extent consistent with the present application.

BACKGROUND

This section of this document introduces various information from the art that may be related to or provide context for some aspects of the technique described herein and/or claimed below. It provides background information to facilitate a better understanding of that which is disclosed herein. This is a discussion of "related" art. That such art, is related in no way implies that it is also "prior" art. The related art may or may not be prior art. The discussion in this section is to be read in this light, and not as admissions of prior art.

The stability of habitable structures has been a concern for builders ever since man began building structures. The level of stability is a function of many factors. The materials used, the presence (or absence) of a frame, the height of the structure, the ground on which it is, built, and still many other factors contribute. Many aspects of design look at these factors and employ certain techniques—most of which are well time-tested—to improve, enhance, or promote the stability of any given structure.

One aspect of design focuses on the structure's relationship to the ground on which it is built. It is familiar to most that many foundations are designed to facilitate the structure's stability. However, there are many structures that need something more or something different, whether because of their size, or because of the soils on, which they are built, or some combination of these and other factors.

For example, many structures use ground improvements, such as piers, or deep foundation systems, such as piles. Piles are vertical load bearing members, essentially long structural elements that are driven into the ground using some kind of vibratory or impact technique, typically using a pile driver hammer.

Ground improvement depth is limited by the depth that installation equipment can penetrate the soil and that there is limited depth at which compaction that can occur. Thus, depending on soil conditions, one might expect to reach a depth of only about 14' (4 m) to 45' (14 m). Deep foundation systems such as Augur Cast-in-Place Piles, on the other hand, are not driven like piles. Instead, a hole is augured into the ground to a prescribed depth, filled with cement, and strengthened with rebar. Penetration can be as deep as 120' (37 m) or more.

Because the hole is augured, the depth of a pile can be many times that of a ground improvement pier. However, piles typically have a smaller horizontal cross-section and generate much larger point loads for the structure they support.

Notably, ground improvements like piers and deep foundation structures like piles are considered in the art and in the industry to be mutually separate approaches to the problem of structural support. This distinction is because they operate differently to address different concerns arising from differing soil and other environmental conditions. Piers, while not as deep, compact and densify the surrounding soil, which stiffens the soil across which the piers are built. This is desirable in some contexts but not others. Piles, on the other hand, do not do this, and so are not desirable in those contexts where piers are desired. Ground improvement piers increase the allowable bearing capacity of the soils to permit spread footing methodologies. Reinforcing steel may be eliminated in some cases.

Additionally, piles create point loading in structure foundations whereas piers spread the load over a much larger surface area and do not require anchoring the foundation to the pier. In many instances, it is desirable, for foundation loads to have larger surface area piers under the foundation than a pile which is anchored to the foundation. Piers are especially important in areas where liquefaction is a concern.

The presently disclosed technique is directed to resolving, or at least reducing, one or all of the problems mentioned above. Even if solutions are available to the art to address these issues, the art is always receptive to improvements or alternative means, methods and configurations. Thus, there exists a need for a technique such as that disclosed herein.

SUMMARY

In a first aspect, a combination pier comprises: a pile disposed in a bore hole from the bottom of the bore hole to a desired depth; and a pier disposed in the bore hole from the desired depth to the surface.

In a second aspect, a combination pier comprises: a lower section disposed in a bore hole, the lower section comprising cast-in-place grout disposed in a bore hole; and an upper section disposed in the bore hole above the lower section, the upper section comprising rammed aggregate.

In a third aspect, a method for constructing a combination pier, comprises: forming a pile in a bore hole from the bottom of the bore hole to a desired depth; and forming a pier from the desired depth to the surface.

In a fourth aspect, a method for constructing a combination pier, comprises: forming a lower section disposed in a bore hole, the lower section comprising cast-in-place grout disposed in the bore hole; and forming an upper section disposed in the bore hole above the lower section, the upper section comprising rammed aggregate.

The above presents a simplified summary of the invention in order to provide a-basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which.

Figure 1:
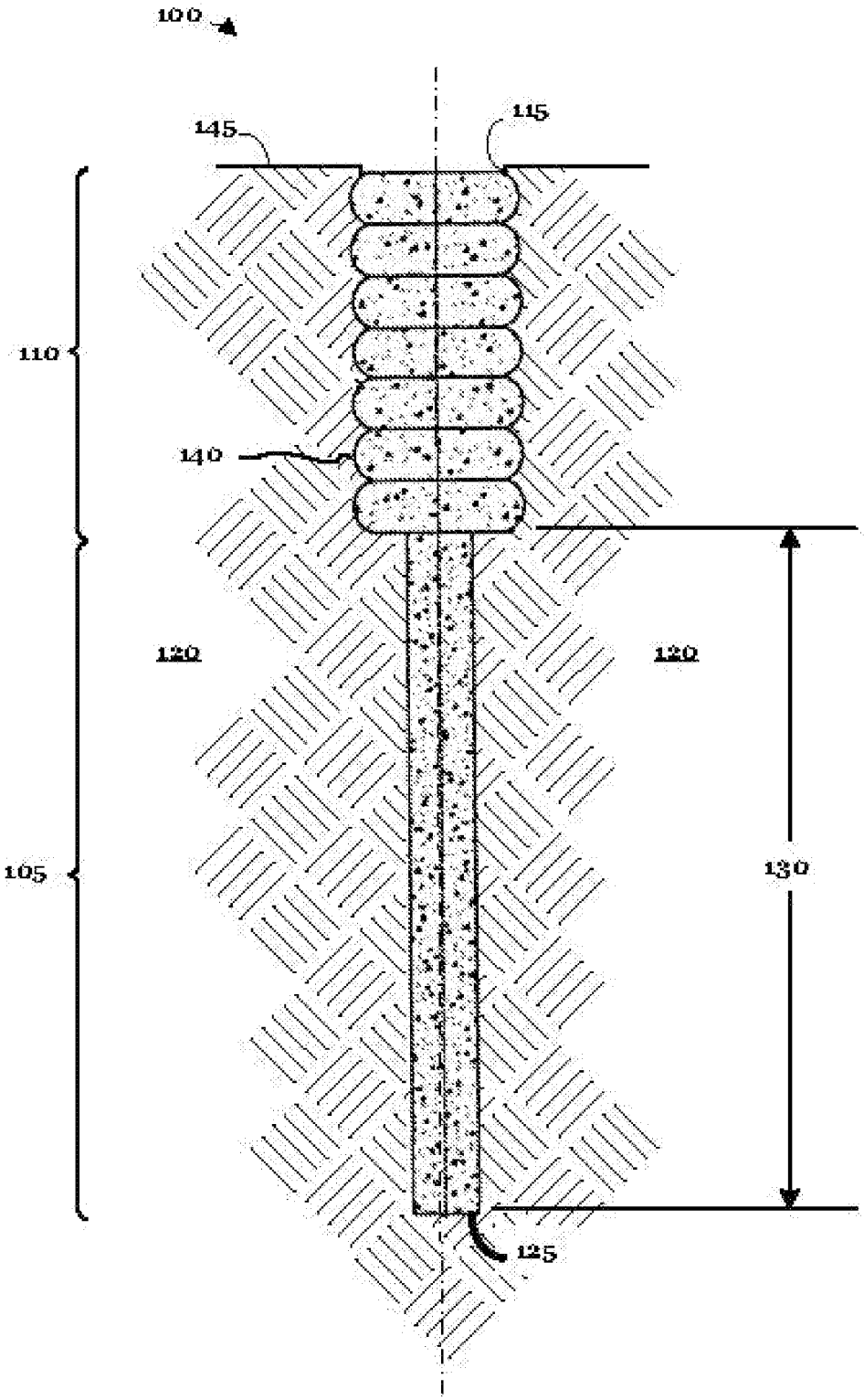
FIG. 1 depicts a first embodiment of a fully constructed combination pier in accordance with one aspect of the presently disclosed technique.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention.

FIG. 1 depicts a first embodiment of a fully constructed combination pier 100 in accordance with one aspect of the presently disclosed technique. The combination pier 100 comprises a lower section 105 and an upper section 110 disposed in a bore hole 115 in the earth 120. The lower section 105 comprises a cast-in-place grout, concrete, or similar material known in the art for this purpose disposed in the bore hole 115. The lower section 105 is disposed in the bore hole 115 from the bottom 125 of the bore hole 115 to a desired depth 130. The upper section 110 comprises of a plurality of "lifts" 140 (only one indicated) and extends from the desired depth 130 to the surface 145 of the earth. The lifts 140, in turn, comprise a rammed aggregate.

Those in the art will recognize from the description and the drawing herein that the lower section 105 of the illustrated embodiment is a pile and that the upper section 110 is a pier. The combination pier 100 therefore comprises a pile—i.e., the lower section 105—disposed in the bore hole 115 from the bottom 125 of the bore hole to a desired depth 130 and a pier—i.e., the upper section 110 disposed in the bore hole 115 from the desired depth 130 to the surface 145. Thus, the presently disclosed technique provides a "combination pier" that exhibits the desirable characteristic of both piers and piles while mitigating the disadvantages of each.

For example, a pier can generally be driven only a few tens of feet, up to perhaps 45' (14 m) into the ground, the maximum depth depending on soil conditions and the pier installation equipment used. Piles, however, can be driven or augured much deeper, perhaps 120' (36 m) deep and sometimes more. The combination pier 100 can reach the depths common to piles because the lower section 105 is, in fact, a pile even, though the uppers section 110 is a pier.

Turning now to FIG. 2A-FIG. 2D, the construction process for an individual combination pier 100 is conceptually illustrated. Some details for the process illustrated and discussed herein as well known in the art. One example of such a detail is the delivery of the grout or concrete as discussed below. These details will not be expressly discussed given their ubiquity in the art so as not to obscure the present invention.

Figure 2A:
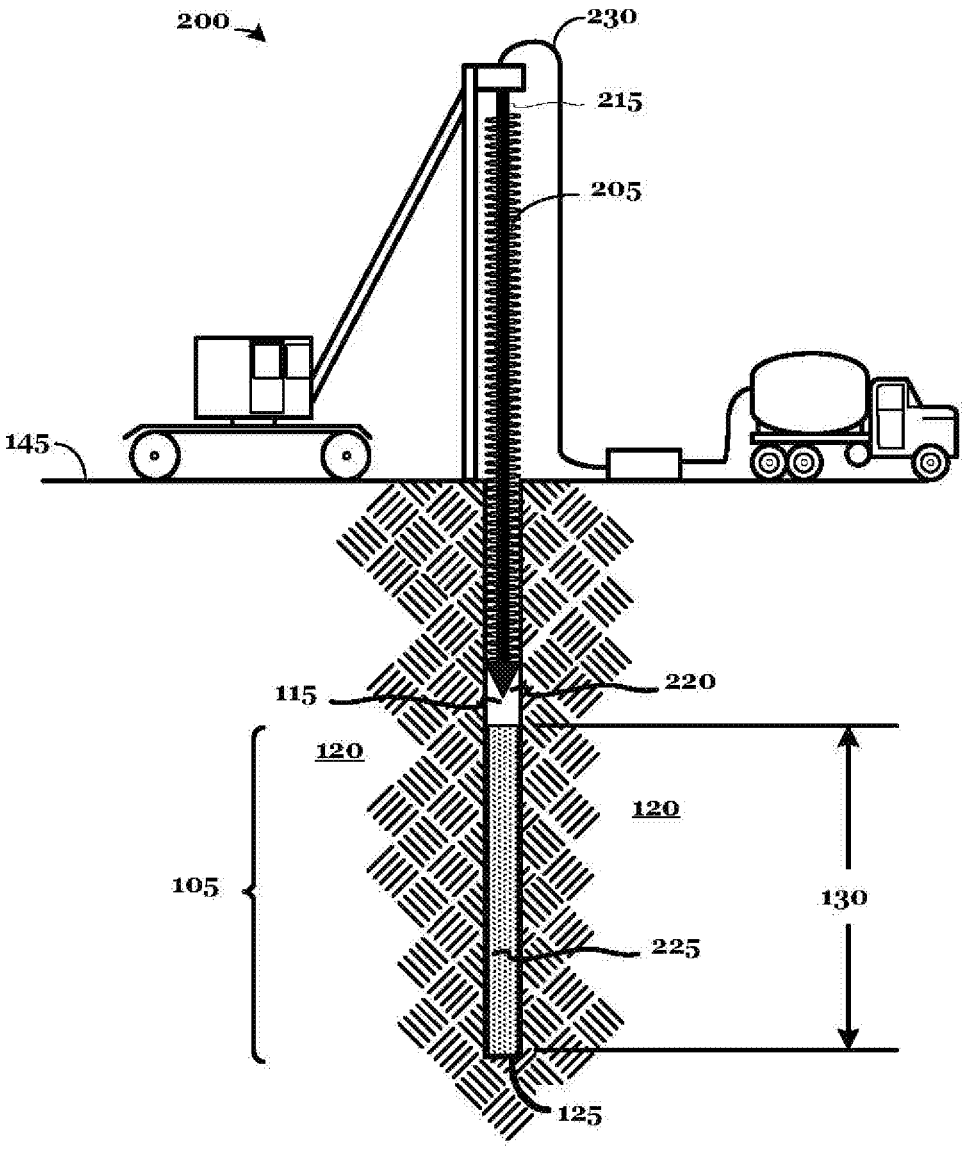
FIG. 2A-FIG. 2D conceptually illustrate the construction of the combination pier of FIG. 1.

FIG. 2A illustrates the creation 200 of the bore hole 115 in which an auger 205 is lowered into the earth 120 to drill the bore hole 115. The augur 205 has a hollow stem 215 capped by a plug 220 at the bottom thereof. The augur 205 is lowered until the bottom 125 of the bore hole 115 reaches the target depth. Soil displaced by the augur 205 as it is lowered is removed from the bore hole 115 by the augur flights through the operation of the augur 205.

The diameter and depth of the bore hole 115 will be implementation specific. A structural engineer will determine these parameters for any particular embodiment given the load the combination pier 100 is expected to bear in light of well-known considerations such as soil type, etc. In the illustrated embodiment, the diameter may be anywhere between 12"-30" (30 cm-76 cm) and the target depth may be up to 120' (36 m).

Once the augur 205 has reached the target depth, concrete, grout, or some other suitable fluid 225 known in the art for this purpose is then pumped through the hollow stem 215 of the augur 205 using a fluid delivery system 230. The augur 205 is then retrieved from the bore hole 115 as shown in FIG. 2A. As it is withdrawn, the weight of the pumped fluid and the pressure of the pumping combine to drop the plug 220 from the stem 215. This permits the fluid 225 to flow through the hollow stem 215 directly into the bore hole 115 as the augur 205 is withdrawn.

There are a variety of fluids known in the art suitable for fabricating piers in this manner. Two—concrete and grout—are mentioned above. However, any suitable fluid known in the art may be used. In the illustrated embodiment, the fluid 225 is a 2500 psi (17.23 MPa) to 5000 psi (34.47 MPa) high compressive strength grout.

Once the fluid 225 hardens, whether by setting or curing, it forms the lower section 105. Construction of the upper section 110 can then begin. The upper section 110 is a pier, and there are many pier construction techniques known in the art. For example, one technique known as the "vibro-replacement" or "wet" method uses high pressure water to create a bore hole. The bore hole is then incrementally filled with graded stone that is compacted at each increment. A second technique known as the "vibro-displacement" or "dry" method that uses a vibratory probe assisted by compressed air to create a bore hole by downward and lateral compaction of the soil around the probe. The bore hole is then incrementally filled with crushed concrete, crushed stone, cement treated aggregate, or some combination of these that is compacted with each increment.

There are a number of other techniques known in the art for constructing ground improvement piers. Any such suitable pier construction technique may be used in the construction of the upper section 110. The illustrated embodiment uses a "rammed aggregate" technique like the one disclosed in U.S. Pat. No. 5,249,892. As noted above and shown in FIG. 1, the uppers section 110 comprises a plurality of lifts 140, each lift 140 comprising a rammed aggregate, which is a consequence of this particular technique.

Figure 2B:
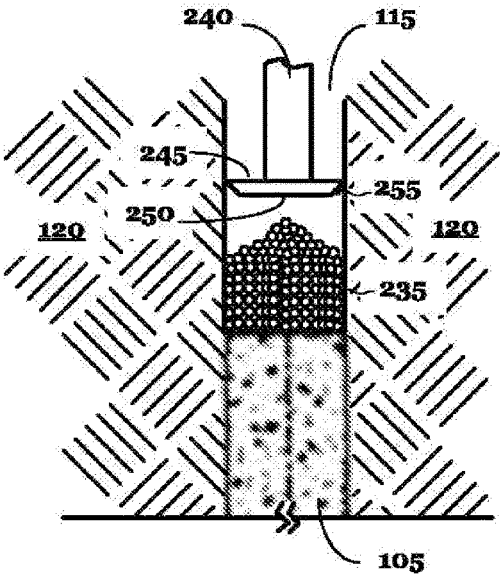

More particularly, and as shown in FIG. 2B, once the lower section 105 hardens, an aggregate 235 is introduced into the bore hole 115 atop the lower section 105 to a predetermined depth. The aggregate 235 may be, for example, crushed concrete, crushed stone, cement treated aggregate, or some combination of these. Any suitable aggregate known in the art for constructing piers may be used. The predetermined depth of the aggregate 235 introduced may ordinarily be as deep as 36' (9.0 m) and as low as 6" (15 cm), but is generally about 12' (4.7 m) in the illustrated embodiment. The predetermined diameter of the aggregate 235 introduced may ordinarily be as high as 36" (0.9 m) and as small as 18" (45 cm).

The aggregate is then compacted, or rammed, using a hammer 265, shown in FIG. 20. The hammer 265 may be a hydraulic hammer or a vibratory hammer, both as, are well, known in the art. Returning to FIG. 2B, the hammer 265 strikes and drives a mandrel 240 includes a tamping head 245 with tamping face 250 and a beveled edge 255. The beveled edge 255 is frusto-conically shaped and angled at about 45° relative to the tamping face 250. The hammer 265 is repeatedly raised and forcefully lowered using a heavy equipment 260 at the surface 145 as is conceptually depicted in FIG. 20.

Figure 2D:
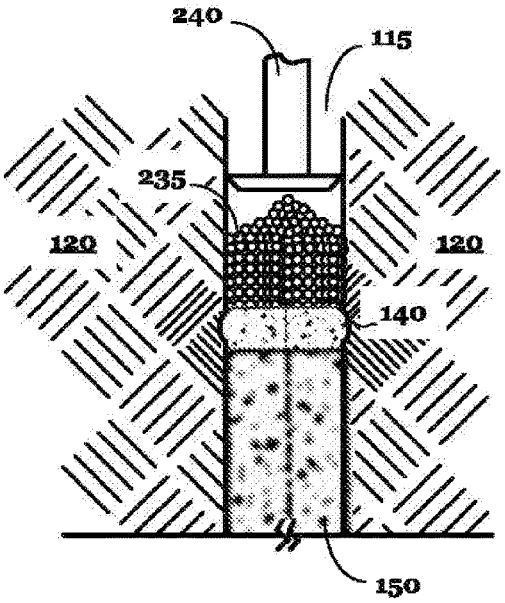

Returning to FIG. 2B, the compaction densifies the aggregate 235, and the force of the compaction causes the densified aggregate 235 to expand outward. This outward expansion is facilitated by the beveled edge 255. The outward expansion also densities the soil in the surrounding earth 120 and induces high intensity lateral stresses therein. As shown in FIG. 2D, the outward expansion creates the noticeable "bulge" in the outer circumference of each lift 140, most notable in FIG. 1, and, hence, the diameter of the bore hole 115. The degree of compaction may vary by implementation, but in the illustrated embodiment, the aggregate is compacted by one-third, or down to two-thirds its original volume. Thus, in the illustrated embodiment, the aggregate 235 will be compacted by 6" (15 cm), from 18" (45 cm) to 12" (30 cm).

Figure 2C:
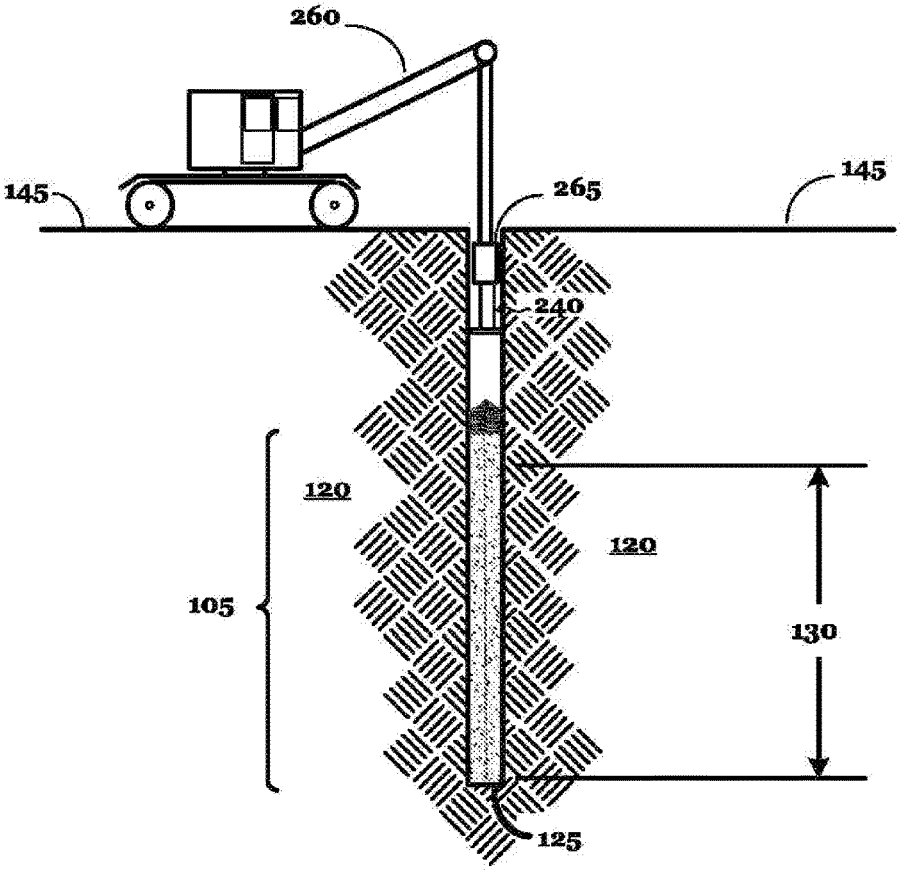

Once the aggregate 235 has been compacted as desired, the hammer 265 is lifted so that additional aggregate 235 can be deposited on top the first lift 140 as shown in FIG. 2D. The process of deposition, compaction, and lifting as shown in FIG. 2B-FIG. 2D until the surface 145 is reached. The resulting combination pier 100, shown in FIG. 1, is the result.

In the description above, the bore hole 115 is described as having a diameter, which is a function of a circular cross-section for the bore hole 115. The bore hole 115 of the illustrated embodiment indeed has a circular cross-section. This is a function of the bore hole 115 being, constructed using the augur 205. However, such a circular cross-section is not required for the practice of the invention. Should other techniques be used for constructing the bore hole 115, other geometries may be employed for the cross-section of the bore hole 115.

Figure 3:
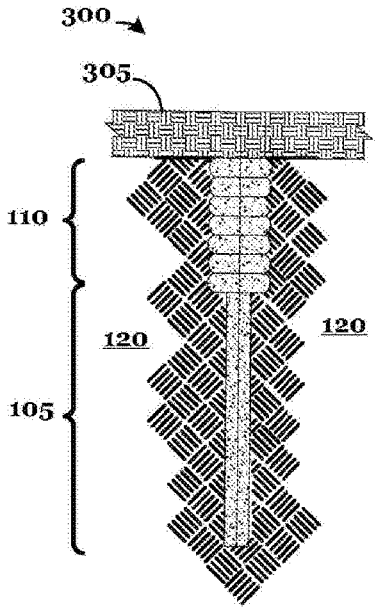
FIG. 3 depicts a second embodiment of a fully constructed combination pier in accordance with one aspect of the presently disclosed technique.
Figure 4:
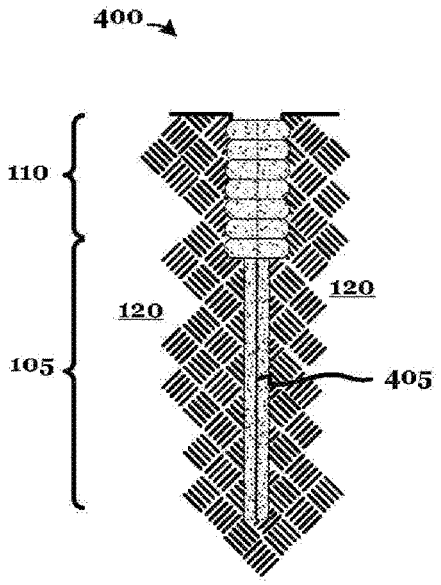
FIG. 4 depicts a third embodiment of a fully constructed combination pier in accordance with one aspect of the presently disclosed technique.
Figure 5:
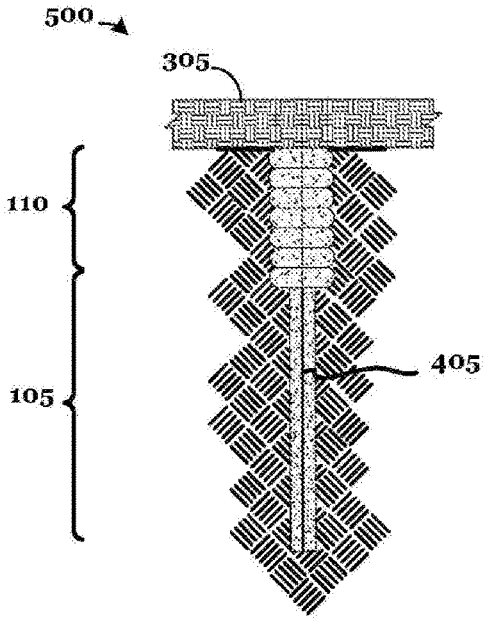
FIG. 5 depicts a fourth embodiment of a fully constructed combination pier in accordance with one aspect of the presently disclosed technique.

Alternative embodiments are shown in FIG. 3-FIG. 5. FIG. 3 depicts a combination pier 300 that includes not only a lower section 105 and an upper section 110, but also a bond barrier 305. The bond barrier 305 may be used in some embodiments to prevent the material of the combination pier 100 from bonding to building materials that may be deposited on, top thereof. FIG. 4 depicts a combination pier 400 that employs a reinforcing member 405 along the centerline of the lower section 105. The reinforcing member 405 in this particular embodiment is a rebar. FIG. 5 depicts a combination pier 500 that includes both the bond barrier 305 and the reinforcing member 405. Still other variations may become apparent to those skilled in the art having the benefit of this disclosure.

The combination pier, as described above, eliminates the need for pile caps, and eliminates point loading of the foundation, and allows the use of spread footing technology in some embodiments. Elimination of the pile caps allows the installation to be permitted as a ground improvement rather than a deep foundation. The combination pier therefore allows, in these embodiments, ground improvements to reach depths of 150' (46 m) below grade or more and lowering the cost of the foundation. Current technology limits ground improvements to depths of less than 50' (15 m) below the surface of the ground.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for constructing a combination pier, comprising:

forming a bore hole in the earth;

forming a pile in the bore hole, the pile extending from the bottom of the bore hole to a desired depth and comprising cast-in-place material;

waiting for the cast-in-place material to harden; and forming a pier comprising rammed aggregate in the bore hole above and in direct contact with the pile once the cast-in-place material has hardened, the pier extending from the desired depth to the surface of the earth.

2. The method of claim 1, wherein forming the pile comprises forming an augured cast-in-place pile.

3. The method of claim 1, wherein forming the pile includes disposing a rebar axially with a longitudinal axis of the bore hole and within the pier.

4. The method of claim 3, further comprising disposing a bond barrier positioned atop the pier.

5. The method of claim 1, further comprising disposing a bond barrier positioned atop the pier.

6. A method for constructing a combination pier, comprising:

forming a lower section disposed in a bore hole formed in the earth, the lower section comprising cast-in-place material disposed in the bore hole;

waiting for the cast-in-place material to harden; and forming an upper section disposed in the bore hole above the lower section and in direct contact with the lower section once the cast-in-place material has hardened, the upper section comprising rammed aggregate.

7. The method of claim 6, wherein the cast-in-place material comprises high compressive strength grout.

8. The method of claim 6, wherein forming the lower section includes:

auguring the bore hole to a terminal depth; and casting the material in the bore hole to a desired depth as the augur is tripped out.

9. The method of claim 6, wherein forming the upper section includes:

depositing an aggregate in the bore hole above the lower section after the cast-in-place material is set to a predetermined depth through a shoe;

ramming the aggregate;

lifting the shoe a predetermined distance; and iterating the above actions until the surface is reached.

* * * * *